US008587457B2

(12) United States Patent
Beuvink

(10) Patent No.: US 8,587,457 B2
(45) Date of Patent: Nov. 19, 2013

(54) METHOD, SYSTEM, AND OPTICAL COMMUNICATION ASSEMBLY FOR OBTAINING TRAFFIC INFORMATION

(76) Inventor: Markus Henricus Beuvink, Uden (NL)

( * ) Notice: Subject to any disclaimer, the term of this patent is extended or adjusted under 35 U.S.C. 154(b) by 372 days.

(21) Appl. No.: 12/867,122

(22) PCT Filed: Feb. 19, 2009

(86) PCT No.: PCT/NL2009/000037

§ 371 (c)(1),
(2), (4) Date: Oct. 27, 2010

(87) PCT Pub. No.: WO2009/104955

PCT Pub. Date: Aug. 27, 2009

(65) Prior Publication Data

US 2011/0032121 A1 Feb. 10, 2011

(30) Foreign Application Priority Data

Feb. 20, 2008 (NL) ..... 1035051

(51) Int. Cl.
*G08G 1/04* (2006.01)

(52) U.S. Cl.
USPC ..... 340/942; 340/933; 340/556

(58) Field of Classification Search
USPC ..... 340/942, 935, 936, 933, 932.2, 556, 340/937; 250/222, 491.1; 235/384; 702/158; 356/446; 701/117–119
See application file for complete search history.

(56) References Cited

U.S. PATENT DOCUMENTS

| | | | | |
|---|---|---|---|---|
| 5,629,704 | A | 5/1997 | Throngnumchai et al. | |
| 6,750,787 | B2 * | 6/2004 | Hutchinson | 340/942 |
| 7,049,980 | B1 * | 5/2006 | Chemelewski | 340/932.2 |
| 7,701,361 | B2 * | 4/2010 | Lee et al. | 340/932.2 |

FOREIGN PATENT DOCUMENTS

| | | |
|---|---|---|
| WO | 0033060 | 6/2000 |
| WO | 2007071032 | 6/2007 |

* cited by examiner

*Primary Examiner* — Anh V La
(74) *Attorney, Agent, or Firm* — Bozicevic, Field & Francis LLP; Bret E. Field

(57) ABSTRACT

The present invention relates to method for obtaining traffic information by the use means of optical signals between a vehicle and an optical communication node, wherein the node forms part of a road network. According to the present invention there is provided a method comprising a first method for detecting a vehicle using a first light detector and first light source associated with the node, wherein the first detection method comprises the steps of: a light signal being transmitted by the first light source; this light signal being detected by the first light detector; characterized by causing the light signal transmitted by the first light source to be reflected on the underside of the vehicle, measuring this reflected light with the first light detector and determining a presence status subject to this measurement. The present invention also provides an optical communication assembly and system for implementing the method.

23 Claims, 7 Drawing Sheets

METHOD, SYSTEM, AND OPTICAL COMMUNICATION ASSEMBLY FOR OBTAINING TRAFFIC INFORMATION

FIELD

The present invention relates to a method for obtaining traffic information by means of optical signals between a vehicle; and an optical communication node, wherein the node forms part of a road rietwork. The present invention also relates to an optical communication assembly and a system for implementing such a method.

BACKGROUND

An example of a system for obtaining traffic information is a system in which the presence of a vehicle is detected. Such detection systems are already known.

A usual detection system comprises a light source and a light detector for respectively transmitting and receiving a light signal. The light source is here usually placed above the vehicle and the detector is situated on the road surface. Detection of a vehicle takes place in that the vehicle interrupts the optical connection between the light detector and the light source.

Because the light source is situated some distance from the detector, these sources and detectors are generally provided with a lens system for focussing the light. If this were not the case, it would be necessary to use high-power light sources in order to still have sufficient signal strength at the position of the light detector. Such sources have a limited lifespan, have rigorous requirements in respect of heat management and consume a great deal of energy.

A drawback of the focussing of light is that it is highly sensitive to dust and/or other small particles which accumulate on the lens system. There is therefore the danger of a vehicle being wrongly detected. It is likewise necessary in such systems to align the light source and light detector relative to each other.

SUMMARY

An object of the present invention is to provide a method wherein the above stated problems do not occur, or do so at least to lesser extent.

According to the invention this object is achieved with the method as now defined in claim 1. This method comprises a first method for detecting a vehicle using a first light detector and first light source associated with the node. This first detection method comprises the steps of a light signal being transmitted by the first light source and this light signal being detected by the first light detector. The method is characterized by causing the light signal transmitted by the first light source to be reflected on the underside of the vehicle, measuring this reflected light with the first light detector and determining a presence status subject to this measurement. The presence status indicates for instance whether or not a vehicle is detected above the sensor. This status need not relate to the specific vehicle which is or can be situated above the sensor, but generally relates to a vehicle in general.

The decision as to whether a vehicle is present can be made by comparing the measurement to a reference measurement that is preset.

Preferably however, the first detection method comprises of comparing said measurement to a previous measurement and a previous presence status. It is hereby possible to obtain a reliable measurement. When a vehicle moves over a node, the measured light intensity will increase. By now comparing two measurements, i.e. a measurement before and during movement of the vehicle above the node, it can be decided on the basis of the detected increase that a vehicle is present. Comparable to this situation is the situation in which it is decided that no vehicle is present on the basis of a detected decrease. A further improvement can be achieved by further combining these data with the presence status. If there occurs no significant change in measured light intensity, it can thus be decided for instance to leave the presence status unchanged. When a previous measurement and/or presence status is used, this creates the further possibility of changing the presence status on the basis of a detected change in measured light intensity.

Because the light is reflected on the underside of the vehicle, the optical distance between light source and light detector, which are both preferably placed in the road surface, is much smaller than in the already known systems. This has the advantage that operation can take place with lower powers and/or that use can be made of diffused reflection. This latter means that the underside of the vehicle is so rough that it does not behave like a mirror, but that the light is diffused over a large wide angle. Because the distance between vehicle and light source is small, this still results in sufficient signal strength for the detector. If the light source likewise covers a relatively large wide angle, a system can be obtained which is less sensitive to dust or other small particles on the detector and/or light source than the already known systems. It is further possible to suffice with a very rudimentary alignment.

The first detection method is preferably supplemented with a second detection method, comprising the step of determining the presence status subject to ambient light measured by the first light detector. Use is made in this method of the shadow effect of a vehicle.

The second detection method does not make use of the light coming from the first light source, but of external sources such as the sun, lampposts and so on. In this second detection method it is also advantageous if it comprises of comparing the ambient light measurement to a previous ambient light measurement and a previous presence status. It must be noted here that the presence status is preferably a property which is separate from the detection method. It is therefore possible to use a plurality of information sources, for instance the results of the first and second detection methods, to determine the presence status.

By separating the first and second detection methods in time the measurement can be modified per method. This is particularly advantageous if use is also made of a previous measurement and a previous presence status as described above. It is thus advantageous if the first detection method is performed in the period of time in which the first light source transmits a light signal, and if the second detection method is performed in the period of time in which the first light source is switched off. In such a manner the two methods can be performed side by side.

In addition to detection of vehicles, such a method can be extended to the optical transmission of information from the vehicle to the node. For this purpose the vehicle is provided on the underside with a second light source. The method then further comprises the steps of transmitting a light signal provided with information with the second light source, measuring this light signal with the first light detector and extracting information from this measurement. This latter information corresponds to the above stated information, preferably in its entirety.

It must be noted that this extension for the purpose of optical transmission of information from the vehicle to the node can also be used separately of the first detection method.

Examples of information which a vehicle can transmit to the communication node include license plate information, information related to the payment transactions, speed of the vehicle and so on.

It is also possible to extend the method to a method for optical transmission of information from the node to the vehicle, wherein the vehicle is provided on the underside with a second light detector. The method then further comprises the steps of transmitting a light signal provided with information with the first light source and measuring this light signal with the second light detector and extracting information from this measurement. This latter information corresponds to the above stated information, preferably in its entirety.

Examples of information which a node can transmit to the vehicle include tailback information, route information, GPS information and so on.

It must here also be noted that this extension to optical transmission of information from the node to the vehicle can also be used separately of the first detection method.

In addition to the first and second detection methods, the above stated optical transmission of information, both from node to vehicle and vice versa, can serve as a third detection method. This method comprises of determining the presence status subject to the at least partial extraction of information. The fact that a part of the information is received is after all an indication that a vehicle is present above the node. Despite the fact that the first, second and third detection methods can be used individually of each other, advantages can be gained by combining at least two methods from said first, second and third detection methods for determining the presence status.

If the light source is covered by for instance a leaf, as a result of which the transmitted light signal cannot reach the detector, a detection can for instance thus still take place by making use of the second detection method.

An advantageous method of combining detection methods can be achieved by means of standardizing the measurements associated with each method of said combination of methods and assigning a numerical reliability to each of these measurements, wherein said reliability depends on at least one of the previous measurement, previous presence status, expected measurement data. The individual measurements can then be weighted and added together with the associated reliability. The decision relating to the presence status can then comprise of comparing the addition to a preset threshold value.

Described as example is the situation wherein the sun is low and shining brightly. The amount of light from the sun incident on the detector greatly depends on the shadow effect of for instance clouds, vehicles and/or buildings. Of further importance is that these shadows are dynamic due to the movement of the sun. It is thus possible for the shadow to move over a detector, whereby a false detection could take place. By now assigning a low reliability to this type of situation, for instance in the case of a very high ambient light intensity, the influence of this measurement in determining the presence status can be reduced. The reliability does not here have to be proportional to the light intensity. In the case of for instance ambient light detection the reliability is low at both high and low intensity, while a high reliability can be assigned to average intensity, for instance in the case of complete cloud cover.

The assigning of reliability can depend on various external factors, such as the time, the season, the geographical position of the sensor and the area surrounding the detector, such as buildings and so on.

The standardization can otherwise make use of the same non-proportional trend. In the case of the first detection method (reflection) a high value of for instance 1 can be assigned to a high measured light intensity (vehicle present) and for instance 0.1 to a low measured light intensity. In the second detection method this can be inverted, i.e. 1 for a low measured light intensity (vehicle present) and 0.1 for a high light intensity. The standardization used can differ per detection method in respect of both quality and quantity.

The reliability of the method can be further increased by using a plurality of nodes for the detection. Nearby nodes can be directly connected to each other, or indirectly in that each node is connected individually to a control room. Information from these nodes, for instance the presence status, can then be combined, so that a more general picture is created of for instance changing ambient light conditions, covering of a single node and so on. If a node is for instance covered, whereby it provides incorrect information, this could be determined by comparing this information to that from nearby nodes and subsequently selecting the correct detection information from this comparison. The detection method therefore preferably further comprises the steps of reading and combining a presence status coming from a node with that from a nearby node, and determining the presence status associated with the first node based on the combined presence status. This method can be performed within one node, for instance because this node retrieves or receives information from nearby nodes and processes this information internally.

It is further advantageous that the first and/or second light source are pulse-operated. The light source can hereby operate at a higher power than in continuous operation, without this adversely affecting the lifespan of the light source. The pulsing character of the light signal further provides a distinguishing feature relative to the ambient light.

For the optical communication between node and vehicle use is preferably made of a pulse modulation technique in order to provide an optical light signal with information. A known example hereof is pulse width modulation, wherein the width of a pulse is varied.

Another option is to vary the time interval between successive pulses, for instance by omitting determined pulses.

The present invention also provides an optical communication assembly comprising a light source and a light detector, which is characterized in that the light source and light detector are connected to a microcontroller adapted to detect a vehicle using the above described first, second and/or third detection method. The assembly is preferably also adapted for optical communication with a vehicle as described above.

In a preferred embodiment the light source and light detector are accommodated in one housing, and this housing is adapted so that it can be placed in a road surface. It is also possible for the housing to be suitable for placing on the road surface.

An optical assembly can be provided with a memory for storing for instance data comprising at least the presence status. If the optical assembly is used in parking management, the information can for instance comprise the number of cars parked per day. It is convenient here if the optical assembly and the memory can be read, in particular externally and preferably wirelessly. The node can preferably be read with a handheld apparatus by means of an optical communication connection which makes use of the first light source. Reading nodes provides a further or different option for combining information from different nodes.

The first and second light source and the corresponding detectors are preferably adapted to function with wavelengths in the infrared to ultraviolet part of the optical spectrum. It is advantageous here to make use of light with a relatively narrow spectrum in order to decrease the influence of the ambient light. Infrared light otherwise has the advantage that it has a lower intensity than visible light in outdoor environments. In addition to laser technology, for instance semiconductor lasers, use can be made of non-coherent light sources such as light diodes. These latter sources usually have a less focussed radiation pattern, whereby detection can take place at multiple angles. As stated above, this reduces the sensitivity of the system to dust and small particles.

The present invention also provides a system for obtaining traffic information by means of optical signals between a vehicle and an optical communication node. Such a system comprises a plurality of mutually connected optical communication assemblies as discussed above. The use of a plurality of nodes can further increase the reliability of the system. Use can also be made of a control room, which for instance collects information from the nodes in order for instance to make an estimate of the chance of a traffic jam delays. In another application the control room provides information to the nodes, which the latter can communicate to the passing vehicles. The connection of the nodes to each other or to the control room is preferably formed by means of redundant electrical wiring. It must be noted that the connection between the mutually connected nodes can also be wireless.

BRIEF DESCRIPTION OF THE DRAWINGS

The present invention will be discussed hereinbelow with reference to the accompanying figures, in which.

DETAILED DESCRIPTION

Figure 1:
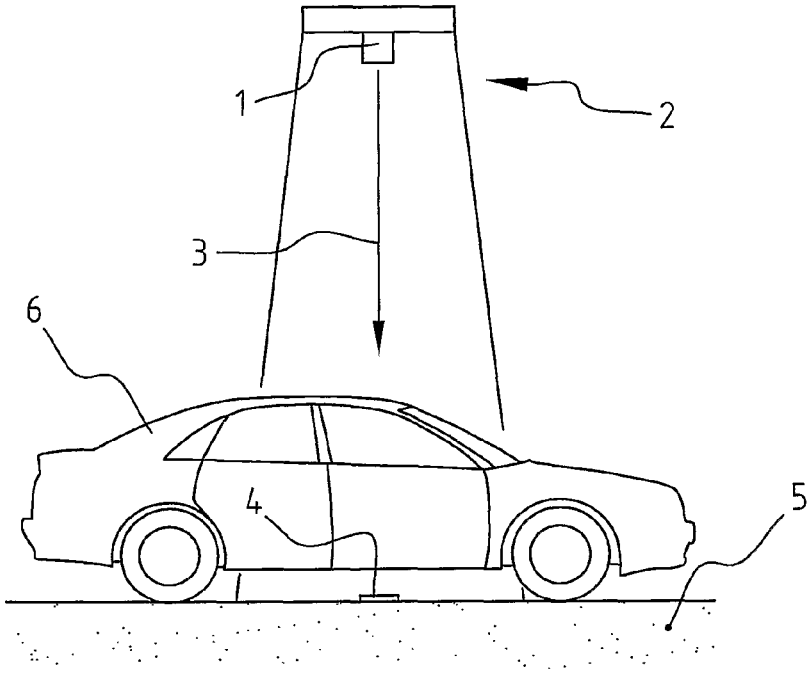
FIG. 1 PRIOR ART
FIG. 1 shows an already known detection system for vehicles.

In the known vehicle detector of FIG. 1 a first light 30 source 1 is connected fixedly to a gate arrangement 2. Light source 1 transmits a focussed light beam 3 in the direction of first light detector 4 situated on a road surface 5. Because a car 6 is situated in the optical line between light detector 4 and light source 1, the optical connection between the two is broken and a vehicle is detected on the basis of this interruption.

Figure 2A:
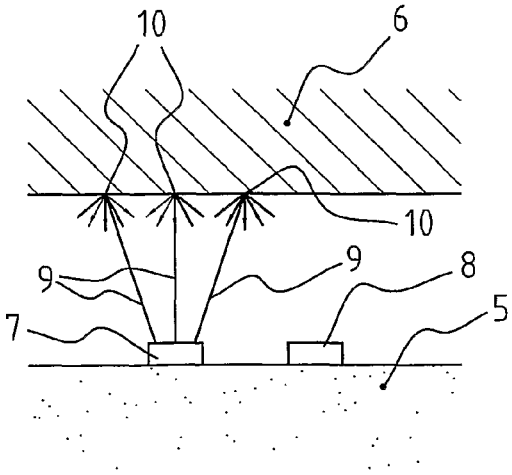
FIGS. 2A and 2B show general embodiments of an optical communication assembly according to the present invention.

FIG. 2A shows a general embodiment of the node according to the present invention, comprising a light source 7 and a light detector 8. Light source 7 transmits non-coherent light 9 at a relatively large wide angle, for instance relatively large compared to laser light. This light 9 is reflected diffusely on the underside of a vehicle 6. This light 10 is measured by light detector 8. This first detection method is possible in addition to the measuring of ambient light by light detector 8, the so-called second detection method.

Figure 2B:
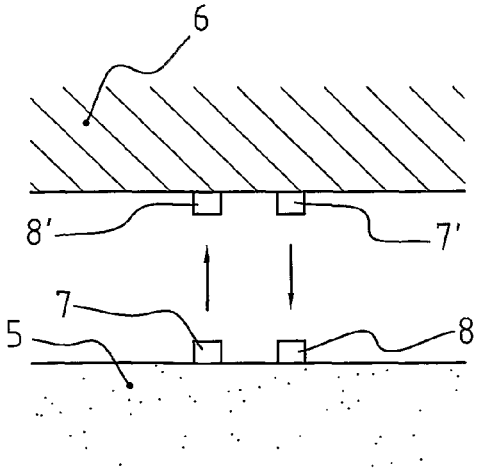

FIG. 2B shows a further development of the embodiment of FIG. 2A. Second light source 7' and second light detector 8' are here arranged for two-way communication between the node and vehicle 6.

Figure 3:
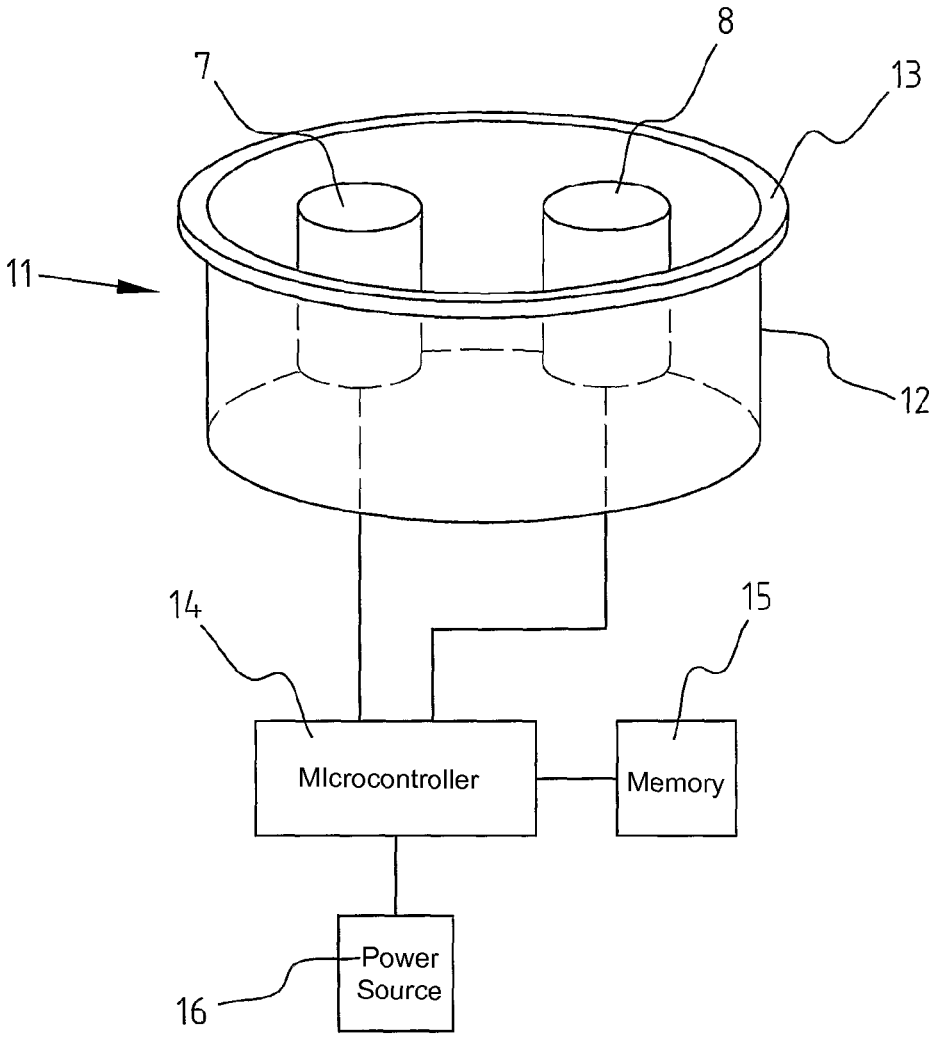
FIG. 3 shows a preferred embodiment of the optical communication assembly of FIG. 2A and/or FIG. 2B.

FIG. 3 shows a preferred embodiment of the optical communication assembly 11 according to the present invention. Light source 7 and light detector 8 are here accommodated in one housing 12. This housing is substantially cylindrical so that it can be easily placed in a cavity in a road surface. Housing 12 also comprises a flange 13 which serves for sealing.

Light source 7 and light detector 8 are connected to a microcontroller 14 which provides for the control of light source 7 for the purpose of both vehicle detection and optical communication, and the reading of light detector 8. Microcontroller 14 is connected to a memory 15 for storage of for instance the presence status, and a power source 16. Power source 16 can comprise a battery. In addition to having an individual power source, the assembly can also be connected to an electricity network. The assembly can also comprise a solar cell which, in combination with a battery connected thereto, provides the assembly with power.

Figure 4A:
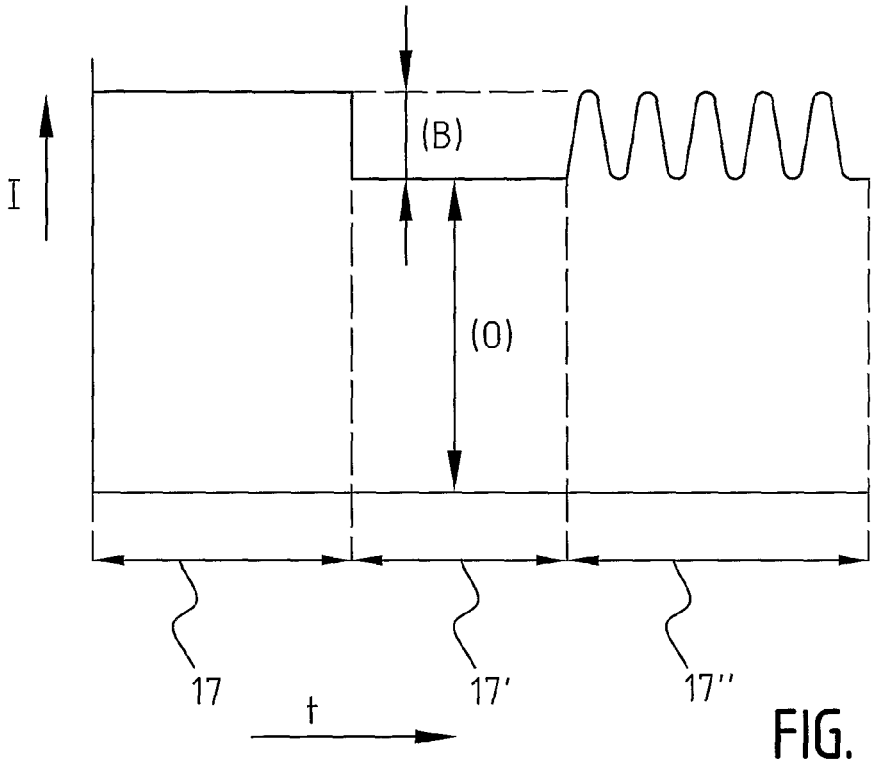
FIGS. 4A and 4B show two intensity-time profiles of received light, wherein different methods are used to control the associated light source.
Figure 4B:
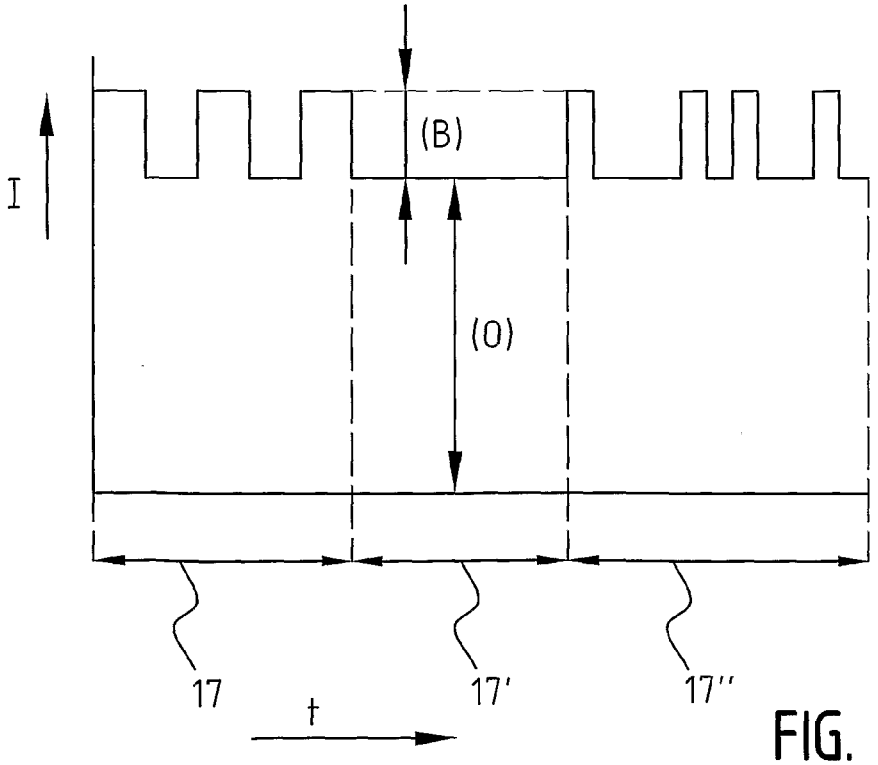

FIGS. 4A and 4B show two intensity-time profiles as measured by light detector 8. In both figures the different functions are separated in time by making use of time slots 17, 17' and 17" for the respective first, second and third detection method, wherein the final time slot 17" also brings about or can bring about communication with vehicle 6. The time is further divided into a number of consecutive frames, wherein the frames comprise the above stated time slots.

In FIG. 4A the light intensity (I) measured by light detector 8 is shown as a function of time. During time slot 17 the first detection method is applied (reflection measurement). The measured light intensity consists here of the ambient light level (O) and the reflected light (B) coming from light source 7. In FIG. 4A light source 7 is controlled with a continuous signal. In FIG. 4B however, use is made of pulses. The use of pulses provides the option of filtering the measured signal in the frequency domain.

Time slot 17' comprises the second detection method (ambient light). Only the ambient light level (O) is thus measured here.

In time slot 17" optical communication with the vehicle takes place. In FIG. 4A use is made of a frequency-modulated signal and in FIG. 4B of a pulse-modulation technique for including information in the light signal. For the sake of simplicity the maximum light level here equals that in time slot 17. The received signal can in general consist of a component coming from first light source 7, which is reflected on the underside of a vehicle 6, as well as a second component coming from second light source 7', which is situated on the underside of vehicle 6. Variations can hereby occur in the received pulses. The pulses transmitted by first light source 7 and second light source 7' can be separated by means of known techniques, such as for instance time multiplexing, frequency multiplexing or code multiplexing. It goes without saying that second light source 7' can also be used to transmit a regular light signal. In this case this signal is not explicitly provided with information, but this signal simply being received by first light detector 8 provides a detection possibility. In order to make a distinction with ambient light, this light signal could be transmitted in pulsed manner.

Figure 5A:
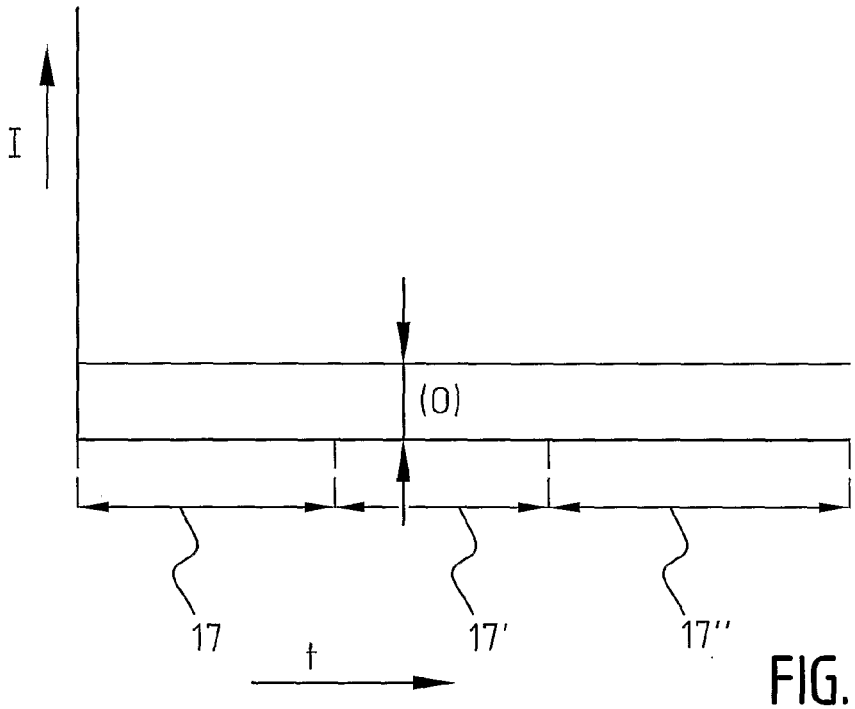
FIGS. 5A and 5B show intensity-time profiles of situations in which respectively a vehicle is not present and is present above the sensor.
Figure 5B:
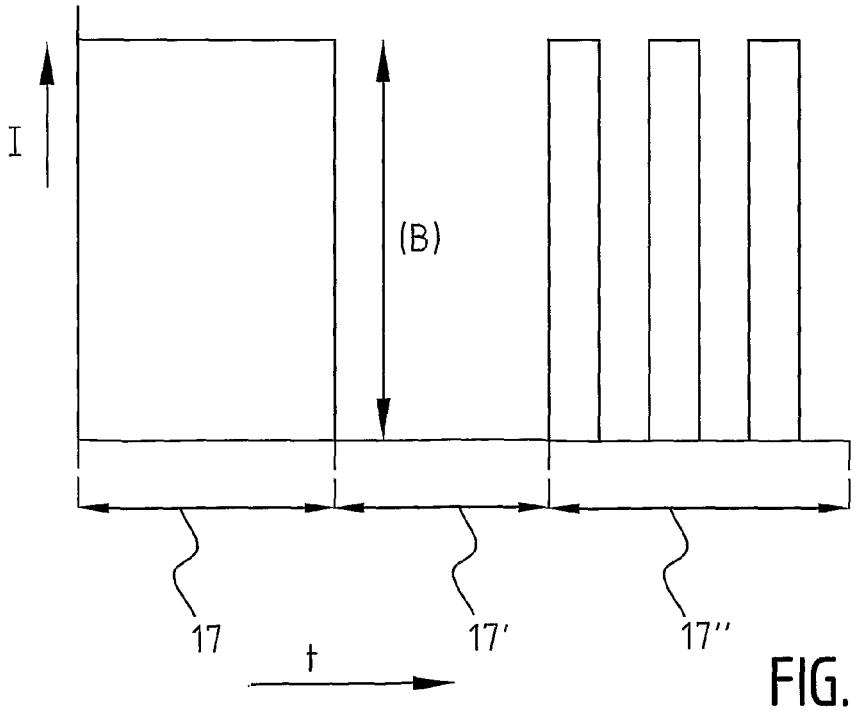

FIGS. 5A and 5B show intensity-time profiles comparable to those of FIG. 4A, wherein a vehicle respectively is not and is present. Due to the absence of a vehicle in FIG. 5A the received light consists mainly of ambient light (O). Once a vehicle has moved above assembly 11, this level drops to a negligible level and the level of the reflected light (B) rises. A vehicle is detected in the first, second and third detection methods.

Figure 6A:
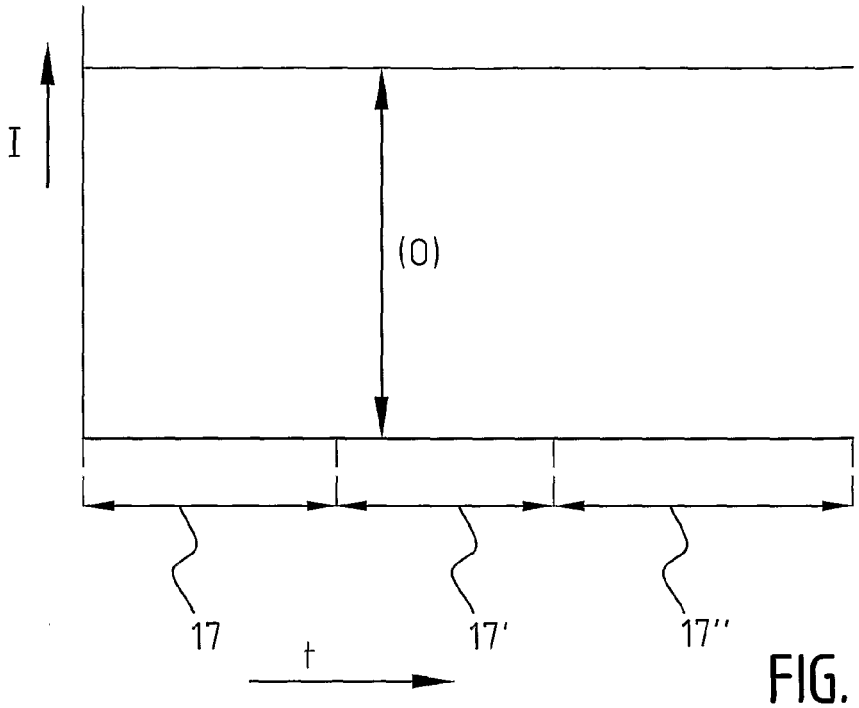
FIGS. 6A and 6B shown intensity-time profiles of situations in which no vehicle is present in either case, but in which a sudden change in ambient light occurs.
Figure 6B:
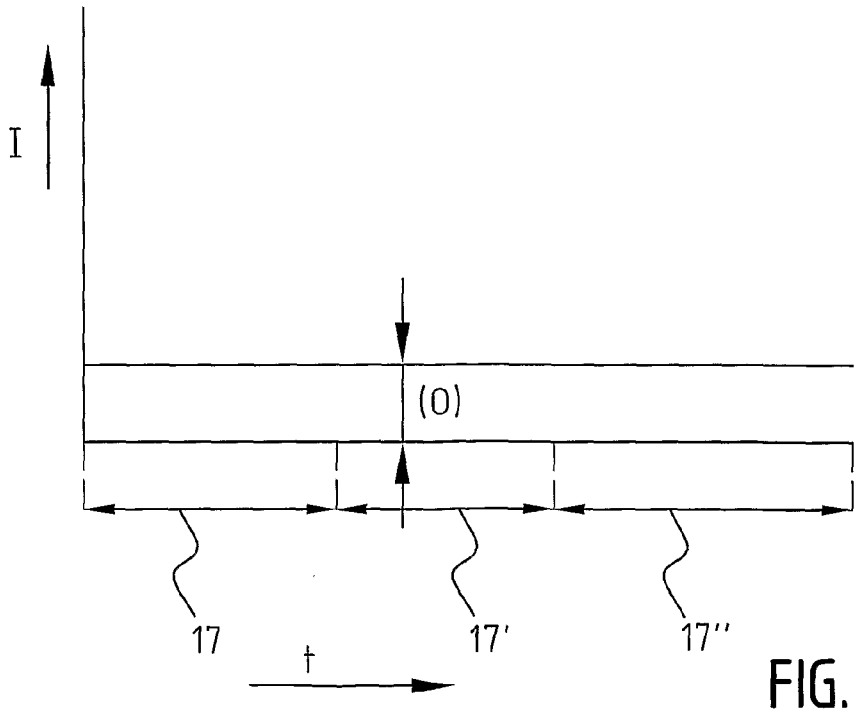

This is different in FIGS. 6A and 6B, wherein no vehicle is situated above assembly 11. In this case FIG. 6B shows the profile resulting from a drop in the ambient light level (O). According to the first detection method, no vehicle is detected. The second detection method indicates the opposite, however. The third detection method likewise does not result in detection of a vehicle. The change in ambient light (O) can for instance be the result of a cloud moving in front of the sun. By now assigning a degree of reliability to each measurement, the measurements in time slots 17, 17' and 17" can be weighted and combined. In the present case the level of the ambient light (O) in FIG. 6A is relatively high. The danger of shadow formation is therefore high. The ambient light detection method is therefore less reliable and is therefore assigned a low reliability. The influence of the second detection method in the sum of the standardized and weighted measurements is therefore small.

Ambient light has a logarithmic character. Light detector 8 is usually based on a PIN photodiode. The higher the lighting level, the higher the so-called photon shot noise. As a result, the signal to be detected disappears in the noise and it is no longer possible to filter it out. The PIN photodiode and associated electronics have a maximum signal amplitude they can process. Once this maximum has been reached no further additional signal will be transmitted, the system in this case being saturated. This has the result that the signal for detecting is very greatly weakened. The noise is also weakened in this case, although it will generally be higher than the signal to be detected.

FIGS. 7-13 show average signal values as a function of time measured by light detector 8 in the first detection method (reflection measurement R) and the second detection method (ambient light measurement S). The situations shown in these figures relate to a car driving over light detector 8. The division into time slots as in FIGS. 4-6 has been dispensed with here in respect of legibility.

Figure 7A:
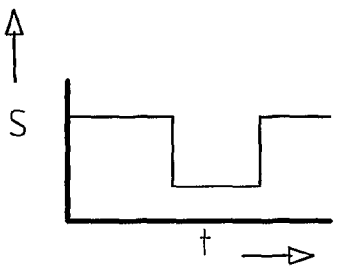
FIGS. 7-13 are intensity-time profiles which show the influence of different ambient conditions on the first and second detection methods.
Figure 8A:
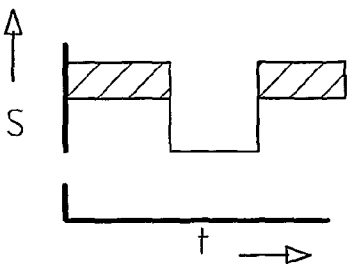
Figure 7B:
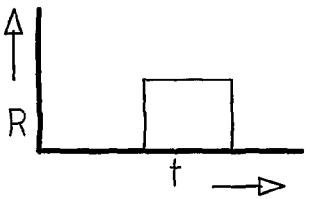
Figure 8B:
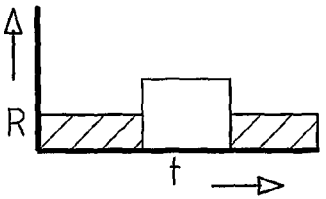

The ideal situation is shown in FIGS. 7A and 7B. This situation occurs in the case of a layer of cloud with a stable thickness and little wind. Both the reflection measurement (FIG. 7B) and the ambient light measurement (FIG. 7A) will generate a clear signal when a vehicle is situated above the node.

In the case of bright sunlight the sun shines on the light detector indirectly or at an angle. The measured ambient light (FIG. 8A) is in this case much higher than in the ideal condition of FIG. 7A. The amount of noise will also increase, indicated by the hatched bars. When a vehicle is situated above the light detector, the amount of ambient light (FIG. 8B) at the light detector will decrease, and so will the amount of noise as well. Without measurement of the ambient light a correct detection of the vehicle is difficult because it can be difficult to determine whether the measured reflection signal is noise or the signal to be detected. In the absence of a vehicle it can be determined that there is a high ambient light level and that a vehicle cannot therefore be situated above the light detector.

An object or vehicle between the light detector and the sun will also cast a shadow on the light detector without the object being situated above the sensor. The reflection signal will however remain low, so no object will be detected.

Figure 9A:
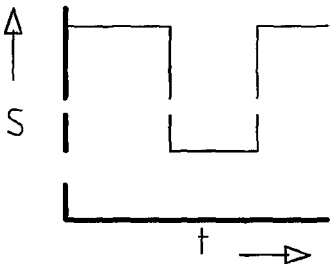
Figure 9B:
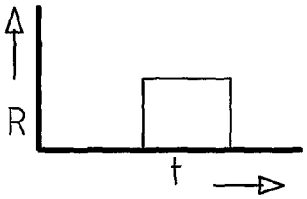

In the case of direct and bright sunlight, as shown in FIGS. 9A and 9B, the sun ideally shines on the light detector. In this case the measured signal is much higher than in the case of indirect sunlight. Because the light detector electronics become saturated, small signal changes can no longer be detected and there is thus no longer any noise either. In this condition objects above the light detector will block the sunlight and the saturation will be resolved. The detection will hereby function normally again.

Figure 10A:
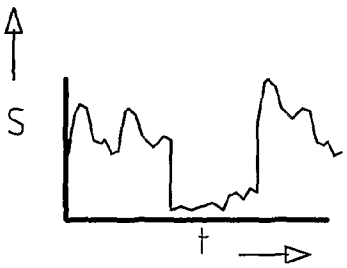
Figure 10B:
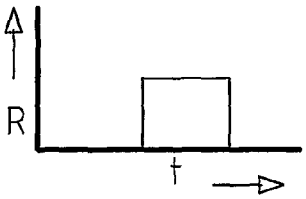
Figure 12A:
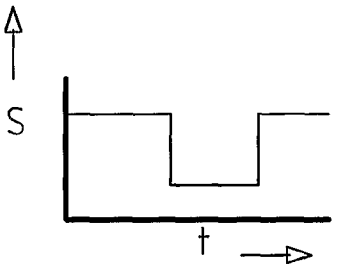
Figure 12B:
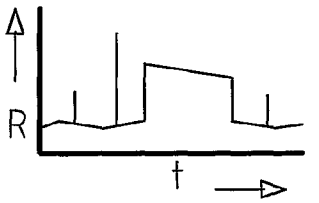
Figure 11A:
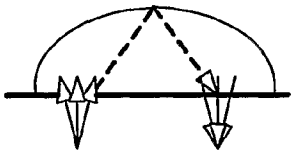
Figure 11B:
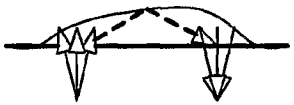
Figure 13A:
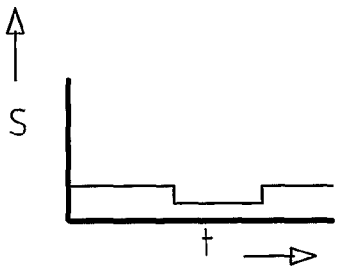
Figure 13B:
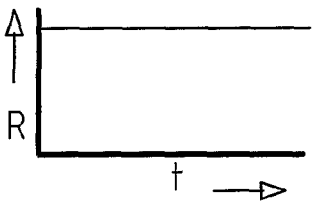

In semi-overcast weather the measured ambient light will vary very strongly, see FIGS. 10A and 10B. When a cloud is situated between the sun and light detector, the light level falls. This level will increase again when the cloud has disappeared. The level will also vary when a vehicle is situated above the light detector. In this situation the use of ambient light is more difficult, although the reflection measurement will function without problem.

Rain will have no effect on the ambient light measurement. Two effects can be observed in the reflection measurement. When a droplet has just fallen or is situated above the light detector, it will cause a high reflection, see FIGS. 11A and 12B. The droplet will then spread over the light detector, thereby causing a low reflection, see FIGS. 11B and 12B. The first effect will cause spikes in the signal, the second effect will cause a large DC drift. This is visible whether or not a vehicle is present. This is because the droplet will dry slowly. If there is ambient light this can be compensated well by making a comparison between the two measuring methods. If there is no ambient light, results of nearby light detectors can be used in order to determine that there is rain. When there are spikes (precipitation) there will be no vehicle. The absence of spikes does not however mean by definition that there is a vehicle. This effect can be made acceptable by a good optical design. Possibilities are to increase the distance between the transmitter and receiver and/or an optical isolation between the two.

A layer of snow will cause the reflection measurement to respond strongly. It will also ensure that less ambient light reaches the light detector, see FIG. 13A. When there is sufficient ambient light, a detection will still be able to take place on the basis of the greatly weakened ambient light. Snow will cover the light detector relatively slowly. This situation can therefore be easily recognised from the slowly increasing reflection and decreasing ambient light levels. This will also be the case for all light detectors in one area. It is possible to switch on a heating (5-10 Watt) arranged in the sensor, whereby the snow can be melted immediately.

Dirt and light damage to the optical parts will result in them becoming less transparent. The signal strength will decrease as a result.

Light can also move within a layer of dirt and thus cause a DC offset. Because both reflected light and ambient light are measured, it is possible to calibrate for this effect.

A different situation (not shown) occurs if a leaf is situated above the node. Due to this leaf the light transmitted by the first light source is at least partly reflected, even if no vehicle is present. Signals associated with the third detection method can hereby also be received, i.e. the signals coming from the first light source and reflected by the leaf. This situation could be accounted for in the reliability of the individual detection methods. The standardization and threshold value can also be adjusted to this condition. When a vehicle is present above the node, the reflected light will increase slightly in the first detection method. The received signal in the third detection method will further also comprise components coming from the second light source. By adjusting the standardization these differences can be detected, whereby a reliable measurement can still be obtained. The fact that signal coming from the second light source is received can for instance thus result in a good detection. If however there is too much reflected light without the presence of a vehicle, for instance in the case of full reflection and/or complete non-transparency, the reliability of the measurement may be reduced. In this case use could be made of information coming from one or more nearby nodes.

The added value of combining the first, second and/or third detection methods is shown in the above described situations. In different situations use is likewise made of past measurements. The change relative to the past measurement is herein related to a change in the presence status.

The present invention is discussed using a number of embodiments and a detailed description. It will be apparent to the skilled person that various modifications, changes and additions are possible without departing from the scope of protection of the invention which will be defined by the appended claims.

An important example here is the mention of a vehicle within the above description and the claims. It will be apparent that the present invention can be applied wholly or partially to other traffic objects, such as pedestrians and/or cyclists, or objects in general.

A significant application of the present invention is related to parking management. Parking space is scarce and expensive. Managers of parking facilities therefore carry out surveys to determine their use. These surveys are usually carried out by interview, which involves limitations and high costs. By placing an optical communication assembly according to the invention in several parking spaces, every parking action is recorded. This assembly is powered by a battery and the collected data are stored in a memory. The communication method is used to read this memory periodically.

For optimum use of parking facilities drivers must know where empty spaces are located. For this purpose large car parks are at the moment provided with a device for recording incoming and outgoing vehicles. The information collected in this way is displayed on panels along the road. This system cannot be used in the case of smaller, scattered parking spaces. Accuracy is also limited because errors occur in the counting of incoming and outgoing vehicles. With the system according to the present invention every parking space in a car park is provided with one or more optical communication assemblies, which are coupled to each other and to a control room via an electrical connection. The control room provides the optical communication assemblies with power, reads them and disseminates the parking information via information panels (DRIP), navigation systems and mobile telephones (GPRS). Because sufficient power is available, the assemblies can be heated in the case of snowfall.

Another application is related to access systems for vehicles. Existing access systems are simple and therefore susceptible to fraud, or require expensive equipment. Because the system according to the present invention involves optical digital communication over a short distance which is very difficult to manipulate, it is fraud-proof and inexpensive. Other applications are also immediately possible by providing vehicles with the described communication system.

In basements and buildings GPS reception is not possible, or hardly so. Navigation systems cannot therefore function in this environment. Even if there were a possibility of sending parking information to a navigation system, it cannot provide accurate information because position determination is not possible. In addition, GPS satellites periodically transmit a calibration signal which reduces changes in the GPS signals resulting from satellite orbit and atmospheric conditions. When a GPS receiver has not had a connection for a longer period of time, it can take a long time before it can determine the position because this calibration is missing. When leaving the parking garage, it therefore takes some time before the navigation system begins to operate. Known alternatives for transmitting these calibration data (GPRS) are based on radio connections and do not work in parking garages either. By providing the parking spaces and the car lanes in a parking garage as well as the cars with the system according to the present invention, the nodes in the parking garage can transmit the correct position. The nodes can also transmit the calibration data. The car hereby knows its location in the parking garage (including storey) and the GPS navigation will be usable immediately upon leaving the garage.

In large car parks and parking garages it can be difficult to find empty spaces. Systems are known for directing parkers to an empty space. Because of the high costs, these systems are only used in parking garages. Known systems consist of displays placed above the car lanes and optionally the parking spaces. The information is collected by sensors per parking space. The sensors used cannot be used in an outdoor environment. These systems are so expensive that they are not generally used. The optical communication assemblies according to the present invention are very much cheaper and, because direct communication with cars is possible, displays are not necessary. The navigation system can be used to transmit this information to the user. Because there is regular contact between the car and the road surface, real-time detailed information relating to empty spaces and route information can be transmitted. Only information which is important for this location need be transmitted. This system also functions in underground car parks where there is no GPRS or GPS reception.

It is usual necessary to pay for parking. There are different systems for this purpose. It can be stated generally that the systems require expensive infrastructure and that the parker must perform operations in order to make the payment. Costs of administering these payments constitute a considerable part of the charges. In the case of pre-payment, the parker will also have to estimate his/her parking time, which has several drawbacks. When both parking spaces and vehicles are provided with this system, it is possible to pay parking charges electronically via the system. The advantage for the user is that this method requires no actions. The advantage for the administrator is that administrative handling of payments becomes much simpler and cheaper.

In the case of large car parks it can be a problem to find a car. This is particularly the case when the storey where a car is located is no longer known, or at airports after a journey. By giving each vehicle and parking space a unique number and connecting the control centre which controls the nodes to the internet, it is easy to send this information to the owner of the vehicle via an SMS or GPRS connection.

Road managers are also interested in knowing what happens on their roads. Detection systems are now placed for this purpose at several locations. These systems are however expensive and their use is for this reason limited. Feedback relating to for instance diversions, amount of traffic and ghost drivers takes place by means of fixed traffic signs, dynamic traffic signs, temporary traffic signs, car radio and, to a limited extent, via GPRS. The drawback of road furniture is that it only informs the user as he/she is driving past. The information is easily missed. Systems based on radio are limited in the amount of information which can be transmitted, and GPRS entails user costs. The system according to the present invention is inexpensive and can be applied at many locations. Cars provided with this system can receive and display information transmitted by the nodes via the navigation system.

Cars can be provided with an optical communication interface. The nodes are then placed in the roadways and in feeder roads. Detailed information can then be sent directly from the roadway to the car. Because the location of the nodes is known, the position of the car is also known. Because there is regular contact between the car and the roadway, detailed information about empty spaces and route information can be transmitted. Only information relevant to this location need be transmitted. Because the vehicle in the parking space can communicate with the control room, it is possible to pay parking charges electronically via this system. This system also functions in underground car parks where there is no GPRS or GPS reception.

Present detection systems make use of detection systems which have a very limited ability to form an overall view of the traffic situation. The availability of information about numbers, type and speed of the vehicles is limited. By placing a series of optical communication assemblies according to the invention in the feeder roads, they can co-act in order to recognise individual vehicles. Vehicles provided with a communication system can send additional information to the traffic regulation installation or receive information. Examples of information to be received are the ideal speed for getting a green light, the time duration until a green light and so on. Examples of information to be transmitted are speed, the exit to be taken at a junction, type of vehicle.

The invention claimed is:

1. A method for obtaining traffic information by means of optical signals between a vehicle and an optical communication node, the node forming part of a road network, comprising a first method for detecting a vehicle using a first light detector and first light source associated with the node, wherein the first detection method comprises the steps of:

transmitting a light signal with the first light source; and detecting the light signal with the first light detector;

characterized by causing the light signal transmitted by the first light source to be reflected on the underside of the vehicle, measuring the reflected light with the first light detector and determining a presence status subject to the measurement.

2. The method as claimed in claim 1, characterized in that the first detection method comprises of comparing said measurement to a previous measurement and a previous presence status.

3. The method as claimed in claim 1 or 2, characterized in that the reflection is substantially diffused reflection.

4. The method as claimed in claim 1, characterized by a second detection method, comprising the step of determining the presence status subject to ambient light measured by the first light detector.

5. The method as claimed in claim 4, characterized in that the second detection method comprises of comparing said measurement to a previous measurement and a previous presence status.

6. The method as claimed in claim 4, characterized in that the first and second detection methods take place separated in time.

7. The method as claimed in claim 1, characterized by a method for optical transmission of information from the vehicle to the node, wherein the vehicle is provided on the underside with a second light source, comprising the steps of:

transmitting a light signal provided with information with the second light source;

measuring the light signal with the first light detector;

extracting information from the measurement.

8. The method as claimed in claim 1, characterized by a method for optical transmission of information from the node to the vehicle, wherein the vehicle is provided on the underside with a second light detector, comprising the steps of:

transmitting a light signal provided with information with the first light source;

measuring the light signal with the second light detector;

extracting information from the measurement.

9. The method as claimed in claim 7, characterized by a third detection method, comprising of determining the presence status subject to the at least partial extraction of information.

10. The method as claimed in claim 3, characterized by combining at least two methods from said first, second and third detection methods for determining the presence status.

11. The method as claimed in claim 10, characterized in that the method comprises the steps of:

standardizing the measurements associated with each method of said combination of methods;

assigning a numerical reliability to each of these measurements, wherein said reliability depends on at least one of the previous measurement, previous presence status, expected measurement data;

weighting the individual measurements with the associated reliability;

adding together the weighted measurements;

comparing the addition to a preset threshold value.

12. The method as claimed in claim 1, characterized in that nearby nodes are connected to each other, and a detection method further comprises the steps of reading and combining a presence status coming from a node with that from a nearby node, and determining the presence status associated with the first node based on the combined presence status.

13. The method as claimed in claim 1, characterized in that the first light source is pulse-operated.

14. The method as claimed in claim 7, characterized in that providing a light signal with information takes place by pulse modulation of the light signal.

15. An optical communication assembly comprising:

a first light source; and a first light detector, characterized in that the first light source and first light detector are connected to a microcontroller adapted to detect a vehicle making use of a detection method as defined in claim 1.

16. Optical communication assembly as claimed in claim 15, characterized in that the assembly is also adapted for optical communication with a vehicle that is provided on the underside with a second light source, wherein the 25 microcontroller is configured to control the first light detector to measure a light signal provided with information that is transmitted by the second light source, and to extract information from this measurement.

17. Optical communication assembly as claimed in claim 15, characterized in that the first light source and first light detector are accommodated in one housing, and the housing is adapted for placement in a road surface.

18. Optical communication assembly as claimed claim 15, characterized in that the assembly comprises a memory for storing data comprising at least the presence status.

19. Optical communication assembly as claimed in claim 18, characterized in that the memory is wirelessly readable.

20. Optical communication assembly as claimed claim 15, characterized in that the first light detector and first light source are adapted for wavelengths in the infrared to ultraviolet part of the optical spectrum.

21. Optical communication assembly as claimed claim 15, characterized in that the first light source is a substantially non-coherent light source.

22. System for obtaining traffic information by means of optical signals between a vehicle and an optical communication node, characterized in that the system comprises a plurality of mutually connected optical communication assemblies as defined in claim 15.

23. Method for obtaining traffic information by means of optical signals between a vehicle and an optical communication node, which node forms part of a road network and which node comprises a first light detector and a first light source that are accommodated in a housing mounted in a road surface, the method comprising a first detection method and a second detection method, wherein the first detection method comprises the steps of:

the first light source transmitting a light signal upwardly from said road surface; and the first light detector measuring ambient light and light reflected from an underside of said vehicle in case said vehicle is present above the communication node;

wherein the second detection method comprises the steps of:

the first light detector measuring current ambient light;

the method further comprising:

determining the presence status of said vehicle subject to a previous presence status, a previous and current measurement obtained using the first detection method, and a previous and current measurement obtained using the second detection method.

* * * * *